US010465124B2

(12) United States Patent
Patten

(10) Patent No.: US 10,465,124 B2
(45) Date of Patent: Nov. 5, 2019

(54) INTERNAL FRICTION CONTROL SYSTEMS FOR HYDROCARBONACEOUS SUBSIDING BODIES

(71) Applicant: Red Leaf Resources, Inc., Salt Lake City, UT (US)

(72) Inventor: James W. Patten, Salt Lake City, UT (US)

(73) Assignee: Red Leaf Resources, Inc., Salt Lake City, UT (US)

( * ) Notice: Subject to any disclaimer, the term of this patent is extended or adjusted under 35 U.S.C. 154(b) by 223 days.

(21) Appl. No.: 15/427,587

(22) Filed: Feb. 8, 2017

(65) Prior Publication Data

US 2017/0226426 A1 Aug. 10, 2017

Related U.S. Application Data

(60) Provisional application No. 62/292,720, filed on Feb. 8, 2016.

(51) Int. Cl.
*C10G 1/02* (2006.01)

(52) U.S. Cl.
CPC ..... *C10G 1/02* (2013.01)

(58) Field of Classification Search
CPC ..... C10G 1/02
See application file for complete search history.

(56) References Cited

U.S. PATENT DOCUMENTS 4,668,129 A 5/1987 Babcock et al.
6,813,949 B2 11/2004 Masaniello et al.
(Continued)

FOREIGN PATENT DOCUMENTS

CN 102345795 A 2/2012
CN 102914632 A 2/2013
(Continued)

OTHER PUBLICATIONS

Spangler et al, "Vertical Soil Arching and TerraFlex." Soil Engineering; GeoTech Systems Corp: Discussion of Soil Arching; 1982; 4th edition; pp. 1-10.

*Primary Examiner* — Randy Boyer
*Assistant Examiner* — Juan C Valencia
(74) *Attorney, Agent, or Firm* — Thorpe North & Western, LLP

(57) ABSTRACT

Systems for extracting hydrocarbons from a crushed hydrocarbonaceous material can include a body of crushed hydrocarbonaceous material. A pipe can be oriented within the body of crushed hydrocarbonaceous material. The placement of the pipe can be such that the pipe is surrounded on top, bottom, and sides by the crushed hydrocarbonaceous material. The body of crushed hydrocarbonaceous material can be made up of portions having different void fractions. An arching control volume of crushed hydrocarbonaceous material can extend upward from the pipe to a vertical control distance. A support portion of crushed hydrocarbonaceous material can be oriented immediately adjacent sides of the arching control volume. The arching control volume can have a higher void fraction than the support portion. Internal friction between the arching control volume and the support portion can reduce stresses on the pipe as the hydrocarbonaceous material subsides.

25 Claims, 9 Drawing Sheets

(56) References Cited

U.S. PATENT DOCUMENTS

| | | | |
|---|---|---|---|
| 6,847,974 | B2 | 4/2005 | VanBuskirk et al. |
| 8,215,869 | B2 | 7/2012 | VanBuskirk |
| 8,365,478 | B2 | 2/2013 | Dana et al. |
| 8,678,040 | B2 | 3/2014 | Patten et al. |
| 8,752,904 | B2 | 6/2014 | Burns et al. |
| 8,851,170 | B2 | 10/2014 | Ayodele et al. |
| 9,079,712 | B2 * | 7/2015 | Patten |
| 2008/0190815 | A1 | 8/2008 | Dana et al. |
| 2015/0027930 | A1 * | 1/2015 | Patten |

FOREIGN PATENT DOCUMENTS

| | | | |
|---|---|---|---|
| CN | 203204916 | U | 9/2013 |
| CN | 203365430 | U | 12/2013 |
| CN | 103527847 | A | 1/2014 |
| CN | 203606356 | U | 5/2014 |
| CN | 103852570 | A | 6/2014 |

* cited by examiner

INTERNAL FRICTION CONTROL SYSTEMS FOR HYDROCARBONACEOUS SUBSIDING BODIES

RELATED APPLICATION

This application claims priority to U.S. Provisional Application No. 62/292,720, filed Feb. 8, 2016 which is incorporated herein by reference.

FIELD OF THE INVENTION

The present invention relates to internal friction control systems for subsiding bodies. Specifically, the present invention relates to internal friction control systems for bodies of crushed hydrocarbonaceous material, such as oil shale. Therefore, the invention relates to the fields of subsidence and hydrocarbon production from hydrocarbonaceous materials.

BACKGROUND

Many processes have been developed for producing hydrocarbons from various hydrocarbonaceous materials such as oil shale and tar sands. Historically, the dominant research and commercial processes include above-ground retorts and in-situ processes. More recently, encapsulated impoundments have been developed for recovering oil from crushed oil shale (In-Capsule® technology). These impoundments are formed primarily of earthen materials, with the crushed oil shale being encapsulated by an impermeable barrier made of rock, soil, clay, and geosynthetics, among other materials. The encapsulated impoundments can be very large, sometimes occupying several acres.

Generally, methods for recovering hydrocarbon products from oil shale have involved applying heat to the oil shale. Heating oil shale allows kerogen in the oil shale to break down through the process of pyrolysis, yielding liquid and vapor hydrocarbon compounds. Heating is also used to recover hydrocarbons from other types of hydrocarbonaceous materials, such as tar sands, coal, lignite, bitumen, peat, and other organic rich rock. Various heating methods have been used. For example, in-situ combustion of hydrocarbons, steam injection, hot combustion gas injection, closed-loop heating conduits, radio frequency heaters, electric heaters, and other heating systems have been used. Encapsulated impoundments in particular have included closed-loop heating conduits. An impoundment can include a body of crushed oil shale or other hydrocarbonaceous material with heating conduits buried in the crushed material. The heating conduits can be connected to a source of heat exchange fluid, such as hot combustion gases. The heat exchange fluid can flow through the conduits, transferring heat through the conduits to the body of crushed material. Heating the hydrocarbonaceous material in this way can produce hydrocarbon liquids and vapors, which can then be recovered from the impoundment.

SUMMARY

Internal friction control systems can be used in processes for extracting hydrocarbons from subsiding hydrocarbonaceous material, such as oil shale. Systems for extracting hydrocarbons from a crushed hydrocarbonaceous material can include a body of crushed hydrocarbonaceous material. A pipe can be oriented within the body of crushed hydrocarbonaceous material. The placement of the pipe can be such that the pipe is surrounded on top, bottom, and sides by the crushed hydrocarbonaceous material. The body of crushed hydrocarbonaceous material can be made up of portions having different void fractions. An arching control volume of crushed hydrocarbonaceous material can extend upward from the pipe to a vertical control distance. A support portion of crushed hydrocarbonaceous material can be oriented immediately adjacent sides of the arching control volume. The arching control volume can have a higher void fraction than the support portion.

Methods of constructing systems for extracting hydrocarbons from crushed hydrocarbonaceous material can include depositing a layer of crushed hydrocarbonaceous material in an enclosure. A pipe can be oriented on the layer of crushed hydrocarbonaceous material. Additional crushed hydrocarbonaceous material can be deposited within the enclosure to form a structured body of crushed hydrocarbonaceous material. The body of structured hydrocarbonaceous material can include an arching control volume of crushed hydrocarbonaceous material extending above the pipe. A support portion of crushed hydrocarbonaceous material can be oriented immediately adjacent sides of the arching control volume. The arching control volume can have a higher void fraction that the support portion.

Methods of reducing stress on a buried pipe during extraction of hydrocarbons from a crushed hydrocarbonaceous material can include heating a body of crushed hydrocarbonaceous material. The body of crushed hydrocarbonaceous material can surround a pipe. The body of crushed hydrocarbonaceous material can include an arching control volume of crushed hydrocarbonaceous material extending upward from the pipe to a vertical control distance. A support portion of crushed hydrocarbonaceous material can be immediately adjacent sides of the arching control volume. The arching control volume can have a higher void fraction than the support portion. Hydrocarbon products can be produced from the crushed hydrocarbonaceous material. During this process, the crushed hydrocarbonaceous material can decrease in volume, causing subsidence of the crushed hydrocarbonaceous material. Frictional forces between the arching control volume and the support portion can mitigate stress on the pipe due to subsidence. The produced hydrocarbon products can be extracted from the body of crushed hydrocarbonaceous material.

Figure 1A:
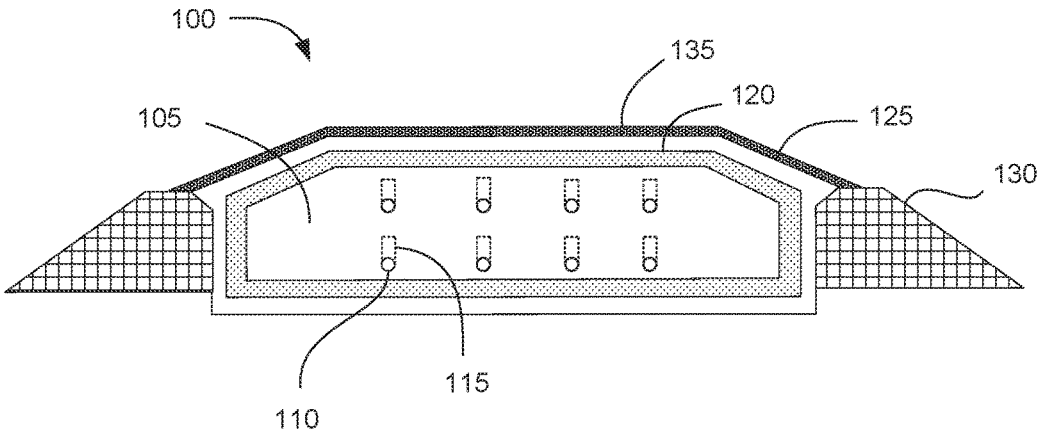
FIGS. 1A and 1B are cross-section illustrations of a system for extracting hydrocarbons from crushed hydrocarbonaceous material in accordance with an embodiment of the present technology.

These drawings are provided to illustrate various aspects of the invention and are not intended to be limiting of the scope in terms of dimensions, materials, configurations, arrangements or proportions unless otherwise limited by the claims.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

DEFINITIONS

In describing and claiming the present invention, the following terminology will be used.

As used herein, "hydrocarbonaceous material" refers to any hydrocarbon-containing material from which hydrocarbon products can be extracted or derived. For example, hydrocarbons may be extracted directly as a liquid, removed via solvent extraction, directly vaporized, by conversion from a feedstock material, or otherwise removed from the material. Many hydrocarbonaceous materials contain kerogen or bitumen which is converted to a flowable or recoverable hydrocarbon through heating and pyrolysis. Hydrocarbonaceous materials can include, but are not limited to, oil shale, tar sands, coal, lignite, bitumen, peat, and other organic rich rock. Thus, existing hydrocarbon-containing materials can be upgraded and/or released from such feedstock through a chemical conversion into more useful hydrocarbon products.

As used herein, "spent hydrocarbonaceous material" and "spent oil shale" refer to materials that have already been used to produce hydrocarbons. Typically after producing hydrocarbons from a hydrocarbonaceous material, the remaining material is mostly mineral with the organic content largely removed.

As used herein, "lean hydrocarbonaceous material" and "lean oil shale" refer to materials that have a relatively low hydrocarbon content. As an example, lean oil shale can typically have from 1% to 8% hydrocarbon content by weight.

As used herein, "rich hydrocarbonaceous material" and "rich oil shale" refer to materials that have a relatively high hydrocarbon content. As an example, rich oil shale can typically have from 12% to 25% hydrocarbon content by weight, and some cases higher.

As used herein, "compacted earthen material" refers to particulate materials such as soil, sand, gravel, crushed rock, clay, spent shale, mixtures of these materials, and similar materials. A compacted earthen material suitable for use in the present invention typically has a particle size of less than about 10 cm in diameter.

As used herein, whenever any property is referred to that can have a distribution between differing values, such as a temperature distribution, particle size distribution, etc., the property being referred to represents an average of the distribution unless otherwise specified. Therefore, "particle size of the insulating material" refers to an average particle size, and "temperature of the body of heated material" refers to an average temperature of the body of heated material.

It is noted that, as used in this specification and in the appended claims, the singular forms "a," "an," and "the" include plural referents unless the context clearly dictates otherwise. Thus, for example, reference to "a layer" includes one or more of such features, reference to "a particle" includes reference to one or more of such elements, and reference to "producing" includes reference to one or more of such steps.

As used herein, the terms "about" and "approximately" are used to provide flexibility, such as to indicate, for example, that a given value in a numerical range endpoint may be "a little above" or "a little below" the endpoint. The degree of flexibility for a particular variable can be readily determined by one skilled in the art based on the context.

As used herein, the term "substantially" refers to the complete or nearly complete extent or degree of an action, characteristic, property, state, structure, item, or result. The exact allowable degree of deviation from absolute completeness may in some cases depend on the specific context. However, the nearness of completion will generally be so as to have the same overall result as if absolute and total completion were obtained. "Substantially" refers to a degree of deviation that is sufficiently small so as to not measurably detract from the identified property or circumstance. The exact degree of deviation allowable may in some cases depend on the specific context. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context. For example, when stating that elements are "immediately adjacent" these elements are in physical contact with one another. Additionally, adjacent structures or elements can in some cases be separated by additional structures or elements between the adjacent structures or elements.

As used herein, "void fraction" refers to the fraction of total volume of a body of particulate material that is void space. The void space includes space between particles that can be occupied by gases or liquids. Void fraction can be expressed as a percentage between 0% and 100% or as a number between 0 and 1.

As used herein, "subsidence" and "subside" refer to downward movement of particles in a body of particulate material. In the context of the present technology, subsidence is caused by extraction of a substance, such as hydrocarbons, from the particulate material. This subsidence is typically much greater than the settling that normally occurs in a body of particulate material when nothing is being extracted from the material. Subsidence can be expressed as a percentage, which unless stated otherwise refers to a percentage in decreased volume of the body of particulate material. Subsidence can also be expressed as percentage of or absolute distance by which the particulate material drops from its original position.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Reference will now be made to the exemplary embodiments illustrated, and specific language will be used herein to describe the same. It will nevertheless be understood that no limitation of the scope of the technology is thereby intended. Additional features and advantages of the technology will be apparent from the detailed description which follows, taken in conjunction with the accompanying drawings, which together illustrate, by way of example, features of the technology.

With the general examples set forth in the Summary above, it is noted in the present disclosure that when describing the system, or the related devices or methods, individual or separate descriptions are considered applicable to one other, whether or not explicitly discussed in the context of a particular example or embodiment. For example, in discussing a device per se, other device, system, and/or method embodiments are also included in such discussions, and vice versa.

Furthermore, various modifications and combinations can be derived from the present disclosure and illustrations, and as such, the following figures should not be considered limiting.

Internal Friction Control Systems for Hydrocarbonaceous Subsiding Bodies

One type of system for extracting hydrocarbons from hydrocarbonaceous material involves filling an impoundment with particulate hydrocarbonaceous material, such as crushed oil shale. Pipes are buried within the body of crushed hydrocarbonaceous material. These pipes can be, for example, heating conduits, liquid collection conduits, vapor collection conduits, fluid injection conduits, access conduits, instrument conduits, and so on. After forming the body of crushed hydrocarbonaceous material with pipes buried therein, the crushed hydrocarbonaceous material is heated for an extended period of time to produce liquid and vapor hydrocarbons from the material. The produced hydrocarbons can then be extracted from the impoundment for use or further processing.

Crushed hydrocarbonaceous materials tend to subside as hydrocarbons are extracted from the materials. Without being bound to a particular theory, it is believed that the hydrocarbonaceous material subsides due to a combination of a decrease in volume of the crushed particles when hydrocarbons are removed therefrom and embrittlement of the particles as hydrocarbons are removed, which causes the particles to be crushed (i.e. resulting in size reduction) and compacted by the weight of overburdening material. The amount of subsidence can vary depending on the hydrocarbon content of the hydrocarbonaceous material and the void fraction of the body of hydrocarbonaceous material, among other factors. Oil shale in particular has been found to subside by 10-40% or more, depending on the particular quality of feedstock. This is in addition to normal gravitational settling of the particles that may occur as the particles are dumped into the impoundment, just as occurs with any particulate material such as sand or soil.

The high degree of subsidence encountered during hydrocarbon recovery can place large stresses on the pipes buried within the body of hydrocarbonaceous material. As the particles of hydrocarbonaceous material subside, an increasing weight is exerted on the pipes from the particles above the pipes. At the same time, the particles below the pipes subside and reduce the amount of support on the pipes from below.

In addition to these stresses, the weight pressing down on a pipe from above can actually be greater than the weight of the particulate material directly above the pipe. This is due to a property of particulate materials known as "arching." Arching has been dealt with in the context of soil arching, which occurs when a shear force is placed on soil. Soil arching is related to internal friction, or friction between particles in soil. Friction between particles can cause some particles to support a portion of the weight of adjacent particles. As a conceptual example to illustrate the soil arching phenomenon, a flat plate can be buried beneath a deep layer of sand. If one section from the center of the flat plate suddenly lowers, the sand immediately above the lowered section will also drop down with the lowered section. However, internal friction in the sand will cause the sand particles directly above the non-lowered sections of the flat plate to support part of the weight of the sand particles over the lowered section. Therefore, at progressively higher locations in the sand, the sand particles over the lowered section will tend more and more to stay in place as their weight is supported by adjacent particles. Eventually, a height above the flat plate will be reached at which none of the sand particles are disturbed by the lowering of the lowered section. This point can be referred to as a "plane of equal settlement," because above this plane no portion of the sand settles any more than the other portions. The regions where sand particles are supported by internal friction tend to form an arched shape, like a bridge, above the lowered section of the flat plate. Thus, this phenomenon is referred to as "arching" or "bridging."

Bridging involves sand supporting itself through internal friction when a void forms under the sand, such as by the lowered section of the flat plate in the example above. However, the same phenomenon can also cause soil to exert a greater than expected force on buried pipes. As an example, rigid pipes are sometimes placed on the surface of the existing ground and then covered with a layer of soil. Building an embankment over a buried conduit is one situation in which this might be done. When the pipe is covered with loose soil, the soil tends to settle under gravitational forces. The soil to each side of the buried pipe can settle all the way down to the original surface of the existing ground. However, the soil directly above the pipe is prevented from settling as far because the rigid pipe holds the soil up. The internal friction of the soil causes the column of soil directly above the pipe to support a portion of the weight of adjacent columns of soil. As a result, the pipe is subjected to an effective weight of the soil directly above the pipe and a portion of the weight of the adjacent soil. This can be referred to as "negative arching."

In the case of pipes buried in a body of subsiding hydrocarbonaceous material, the effective weight on the pipes can be substantially greater than typical soil or sand environments. As hydrocarbons are removed, the hydrocarbonaceous material can subside much more than sand or soil would through gravity-driven settling alone. Negative arching causes a large portion of the weight of adjacent particles to be supported by the column of particles directly above the pipes. If the force on the pipes is great enough, the pipes can rupture. In the case of product recovery conduits, rupture can lead to loss of valuable products. In the case of heating conduits, rupture can lead to inefficient heating and potential contamination of the hydrocarbon products.

The presently disclosed technology involves methods for reducing the force on pipes buried in a subsiding body of particulate hydrocarbonaceous material from which hydrocarbons are produced. The force can be reduced by designing the body of hydrocarbonaceous material so that portions of the hydrocarbonaceous material that are subject to a greater degree of subsidence are placed directly over the pipes. Portions of hydrocarbonaceous material can be subject to different amounts of subsidence. For example, oil shale with a higher kerogen content can subside more than oil shale with a lower kerogen content. Thus, the amount of hydrocarbons present in the hydrocarbonaceous material can affect the degree of subsidence. Additionally, particulate hydrocarbonaceous material with a higher void fraction can have a higher degree of subsidence than material with a lower void fraction. By considering such factors (e.g. kerogen content, richness, void space, etc), a column of hydrocarbonaceous material that has a higher degree of subsidence can be placed directly over a pipe, while the adjacent material has a lower degree of subsidence. As hydrocarbons are produced, the column of material above the pipe tends to subside more than the adjacent material. Internal friction between the column of material above the pipe and the adjacent material induces positive arching in the material. That is, the adjacent material tends to support a portion of the weight of the column of material over the pipe. In this way, the load on the pipe is reduced.

With this background in mind, FIG. 1 illustrates a system 100 for extracting hydrocarbons from a crushed hydrocarbonaceous material. The system includes a body of crushed hydrocarbonaceous material 105 and pipes 110 oriented within the body of crushed hydrocarbonaceous material. The pipes can be surrounded on top, bottom, and sides by the crushed hydrocarbonaceous material. An arching control volume 115 extends upward from each pipe. The arching control volumes are portions of the body of hydrocarbonaceous material that have a higher void fraction. The arching control volumes extend upward from the pipes to a vertical control distance. Portions of the hydrocarbonaceous material immediately adjacent on the sides of the arching control volume act as support portions. The particulate material in the support portions has a lower void fraction than the arching control volume. When the hydrocarbonaceous materials subside due to removal of hydrocarbons, the support portions support part of the weight of the arching control volume. This reduces the load on the pipes.

FIG. 1A also shows additional components of the system 100 present in this specific embodiment. The body of crushed hydrocarbonaceous material 105 is surrounded by an insulating layer 120. A barrier layer 125 surrounds the insulating layer. The barrier layer, insulation layer, and body of hydrocarbonaceous material can together be referred to as an impoundment, because the barrier layer prevents materials such as hydrocarbon liquids and vapors from escaping. A variety of materials can be used in forming the impoundment. For example, the insulating barrier can be formed of a clay amended soil. Reference for additional details for operating and building an encapsulated system can be made to U.S. Pat. No. 7,862,705, U.S. Patent Application Publication No. 2013/0334106-A1, and U.S. Provisional Application No. 62/062,713, filed Oct. 10, 2014, which are each incorporated herein by reference. Side berms 130 support the sides of the impoundment. Finally, a layer of cover fill 135 is deposited on the top of the impoundment.

Figure 1B:
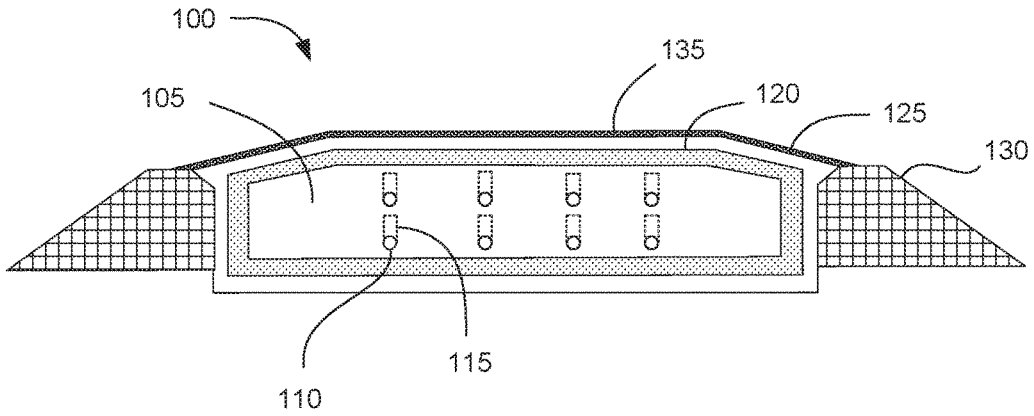

FIG. 1B shows the same system 100 after the crushed hydrocarbonaceous materials have subsided. The depth of the body of crushed hydrocarbonaceous material 105 has decreased compared to FIG. 1A. The sloped parts of the ceiling of the impoundment have flattened somewhat as the hydrocarbonaceous material subsided. In the particular embodiment shown, the pipes 110 are designed to be moveable in the vertical direction. As shown in FIG. 1B, the pipes have moved with the subsiding hydrocarbonaceous material so that the rows of pipes are closer together than in FIG. 1A. Such moveable pipes can be designed using flexible pipe sections or collapsible pipe manifolds, as described in more detail below.

The various components of the system shown in FIGS. 1A and 1B are not necessarily always included in all embodiments of the present technology. Generally, systems for extracting hydrocarbons from crushed hydrocarbonaceous material can include a body of crushed hydrocarbonaceous material. Examples of hydrocarbonaceous material include, but are not limited to, oil shale, tar sands, lignite, bitumen, coal, peat, harvested biomass, and any other hydrocarbon-rich material. Many of these materials are characterized by the ability to produce liquid and gaseous hydrocarbons by heating the materials to elevated temperatures. For example, oil shale can be heated to temperatures sufficient to pyrolize kerogen in the oil shale, which breaks down the kerogen into liquid and gaseous hydrocarbons with lower molecular weights. The operating temperature for producing hydrocarbons can be selected depending on the type of hydrocarbonaceous material, the desired molecular weight of hydrocarbon products, the desired phase (liquid or vapor) of hydrocarbon products, and the desired rate of production of hydrocarbon products. For example, lower temperatures can be applied for longer periods of time, or higher temperatures can be applied for shorter periods of time. In some embodiments, the temperature of hydrocarbon production can be from about 95° C. to about 550° C., and in other aspects from 330° C. to 400° C.

In certain embodiments, the system can include an insulating layer surrounding the body of crushed hydrocarbonaceous material. The insulating layer can comprise a variety of insulating materials. Generally, the insulating layer can retain the heat in the heated body of crushed hydrocarbonaceous material so that the outer layers of the impoundment and the environment outside the impoundment are not damaged by high temperatures. Examples of insulating materials include, but are not limited to, gravel, sand, spent oil shale, open-cell foam, fiberglass, mineral wool, and so on. In one embodiment, the insulating material can be crushed spent oil shale. Other optional insulation materials can include biodegradable insulating materials, e.g. soy insulation and the like. This is consistent with embodiments wherein the impoundment is a single use system such that insulations and other components can have a relatively low useful life, e.g. less than 1-2 years. This can also reduce equipment costs as well as reduce long-term environmental impact.

The insulating material can be porous. In some cases, the insulating material can be a particulate material that is loosely formed into an insulating layer so that spaces remain between the particles. In such embodiments, the porosity of the material can be provided by the spaces between the particles although the particles themselves may not be particularly porous. In other cases, individual particles of insulating material can contain microscopic or visible pores so that the particles themselves are porous. In such embodiments, the porosity of the material can be provided both by the spaces between the particles and by the pores contained in the particles. In one example, the insulating material can be spent oil shale. Particles of spent oil shale can contain many small pores where kerogen has been converted into smaller hydrocarbons and removed. In some embodiments, the particles of insulating material can have a porosity from about 0.1 to about 0.5. In other embodiments, the porosity can be from about 0.15 to about 0.3. In further embodiments, the insulating layer can have a void space, referring to space between particles, from about 20% to about 50%. In still further embodiments, the void space can be from about 25% to about 40%.

In some embodiments, the insulating material can be a particulate earthen material. For example, the insulating material can be crushed spent oil shale, crushed lean oil shale, or other crushed rock. In one example, the insulating material can be a particulate earthen material having a particle size from about 1 mm to about 5 cm. In another example, the particle size can be from about 1 mm to about 2 cm. In a specific embodiment, the insulating material can be crushed spent or lean oil shale with an average particle size of about 1 mm to about 2 cm.

In hydrocarbon production processes, insulating material can be obtained from materials produced as part of the process. For example, hydrocarbonaceous materials can be mined to use as a feedstock for hydrocarbon production. After producing hydrocarbons from the hydrocarbonaceous material, the spent hydrocarbonaceous material can be crushed and used as insulating material in another impoundment. Additionally, other rock that may be mined along with the hydrocarbonaceous material can be used as the insulating material, or lean hydrocarbonaceous material that would not be profitable to use as feedstock can be used as insulating material.

The system can further include a barrier layer surrounding the body of crushed hydrocarbonaceous material. The barrier layer can be outside the insulating layer, if present. Generally, the barrier layer can include materials that block escape of hydrocarbon fluids from the impoundment. The barrier layer can also block entrance of air or water from outside the impoundment. Non-limiting examples of suitable barrier layer materials for use in forming the impoundment can include clay, bentonite clay (e.g. clay comprising at least a portion of bentonite which includes montmorillonite), compacted fill, refractory cement, cement, grout, high temperature asphalt, sheet steel, sheet aluminum, synthetic geogrids, fiberglass, rebar, hydrocarbon additives, filled geotextile bags, polymeric resins, PVC liners, or combinations thereof. For large scale operations forming the impoundment at least partially of earthen material can provide an effective barrier.

In certain embodiments, the barrier layer can comprise a swelling clay. Examples of swelling clay include, but are not limited to, bentonite clay, montmorillonite, kaolinite, illite, chlorite, vermiculite, etc. Most often, the barrier layer can include soil amended with a swelling clay. For example, the barrier layer material can be bentonite amended soil. Bentonite amended soil can be hydrated by adding water, which causes the particles of bentonite to swell. The hydrated bentonite particles and the other particles present in the soil form an impermeable matrix that is an effective barrier to vapors and liquids. In some cases, bentonite amended soil can comprise, by weight, about 5-20% bentonite clay; 15-20% water; and the remainder soil or aggregate. When hydrated, the bentonite component swells to several times the dry volume of the bentonite clay thus sealing the soil such that this material is plastic and malleable.

The barrier layer can form an impoundment to restrict passage of fluids into or out of the impoundment. As such, hydrocarbon fluids produced from hydrocarbonaceous material inside the impoundment can be retained inside the impoundment to avoid contamination of the environment outside the impoundment and loss of valuable hydrocarbon products. Thus, the barrier layer can be free of a continuous vapor phase and can be formed of packed solid particulate material within a continuous liquid phase. In some embodiments, the impoundment can prevent substantially all passage of hydrocarbons outside the impoundment except through designated conduits such as gas and liquid hydrocarbon outlet conduits. Such outlet conduits can include one or more drains in a lower portion of the impoundment which allow draining liquid hydrocarbons, one or more gas outlets in an upper portion of the impoundment for withdrawing gases and vapors, one or more intermediate outlets located at intermediate heights within the body of heated material for withdrawing hydrocarbon liquids and gases with various boiling points, or combinations of these different outlets. Outlet conduits can penetrate through the impermeable barrier layer to allow hydrocarbon products to be collected from the impoundment. The area of the barrier layer immediately surrounding the conduits can be sealed against the exterior surfaces of the conduits so that no leakage of hydrocarbons occurs at the interface between the conduits and the barrier layer.

Additionally, the impoundment can restrict passage of air, water, or other fluids into the impoundment from the surrounding environment. Leakage of air into the impoundment can potentially cause problems with the process of recovering hydrocarbons from hydrocarbonaceous materials. For example, the presence of oxygen can result in polymerization and agglomeration of the hydrocarbons and other contents within the impoundment. Further, the presence of oxygen can induce undesirable combustion within the system. In some embodiments, the impoundment can prevent substantially all passage of fluids into the impoundment from the surrounding environment. Optionally, fluids can be fed into the impoundment through designated inlet conduits. In some cases inlet conduits can be used to introduce heated gases into the impoundment to heat the body of hydrocarbonaceous material. In one such example, heating conduits can be used to introduce hot combustion gas into the impoundment. Other fluids that can be introduced into the impoundment through inlet conduits include, but are not limited to, steam, inert or non-oxidizing gases, solvents, hydrocarbons, catalysts, and so on. Accordingly, the impoundment can prevent passage of fluids in either direction, either into or out of the impoundment, with the exception of designated inlet and outlet conduits.

Although the barrier layer can be formed of a variety of materials, in one aspect, the barrier layer can be formed of a particulate material with an average diameter of 0.1 cm to about 5 cm, and most often from about 0.2 cm to about 1 cm. Similarly, the particulate material can have a range of sizes from about 74 micrometers (200 mesh) to about 10 cm (⅜"). The barrier layer can have a thickness sufficient to prevent leakage of fluids into or out of the impoundment. In one example, the barrier layer can have a thickness from about 10 cm to about 2 m. In another example, the barrier layer can have a thickness from about 50 cm to about 1 m.

Walls of the impoundment can additionally include external support material. In some embodiments, the barrier layer can be supported by an outer wall formed from earthen material. The outer walls can include tailings berms, compacted earth, undisturbed geological formation, gabions, geosynthetic fabric, and other supporting material. In one embodiment, the impoundment can be formed as a free standing structure, i.e. using existing grade as a floor with side walls being man-made. In the example shown in FIGS. 1A and 1B, the walls are supported by side berms 130. The side berms can be built up of crushed rock or dirt. Alternatively, the impoundment can be formed within an excavated pit by forming the barrier layer against undisturbed formation surfaces of the excavated pit.

The impoundment can be constructed on top of a surface of undisturbed earth. The undisturbed surface can provide support to the floor of the impoundment. Another layer of earth can be deposited on top of the impoundment. This layer can be loose fill dirt or any other suitable material.

Although the impoundment can have any suitable size, the present technology is especially useful for large scale systems for extracting hydrocarbons. Larger impoundments or systems with multiple impoundments can readily produce hydrocarbon products and performance comparable to or exceeding smaller impoundments. As an illustration, single impoundments can range in size from 15 meters across to 200 meters across, and often from about 100 to 160 meters across. Optimal impoundment sizes may vary depending on the hydrocarbonaceous material and operating parameters, however suitable impoundment areas can often range from about one-half to ten acres in top plan surface area. Additionally, the impoundment can have a depth from about 10 m to about 50 m.

The impoundment can be used to heat the crushed hydrocarbonaceous material for a relatively long amount of time. For example, in some examples the heating time can be from about 2 days to about 2 years, such as from about 3 days to about 2 years or from about 1 week to about 2 years. In other examples, the heating time can be from about 3 months to about 8 months. In embodiments involving production of hydrocarbons from hydrocarbonaceous material, the heating time can be sufficient to recover most of the hydrocarbons from the hydrocarbonaceous material. In one example, the heating time can be sufficient to recover at least 99% of the convertible hydrocarbons from the hydrocarbonaceous material. Long heating times used in conjunction with moderate temperatures can in some cases produce better quality hydrocarbon products than shorter heating times with higher temperatures.

Figure 2:
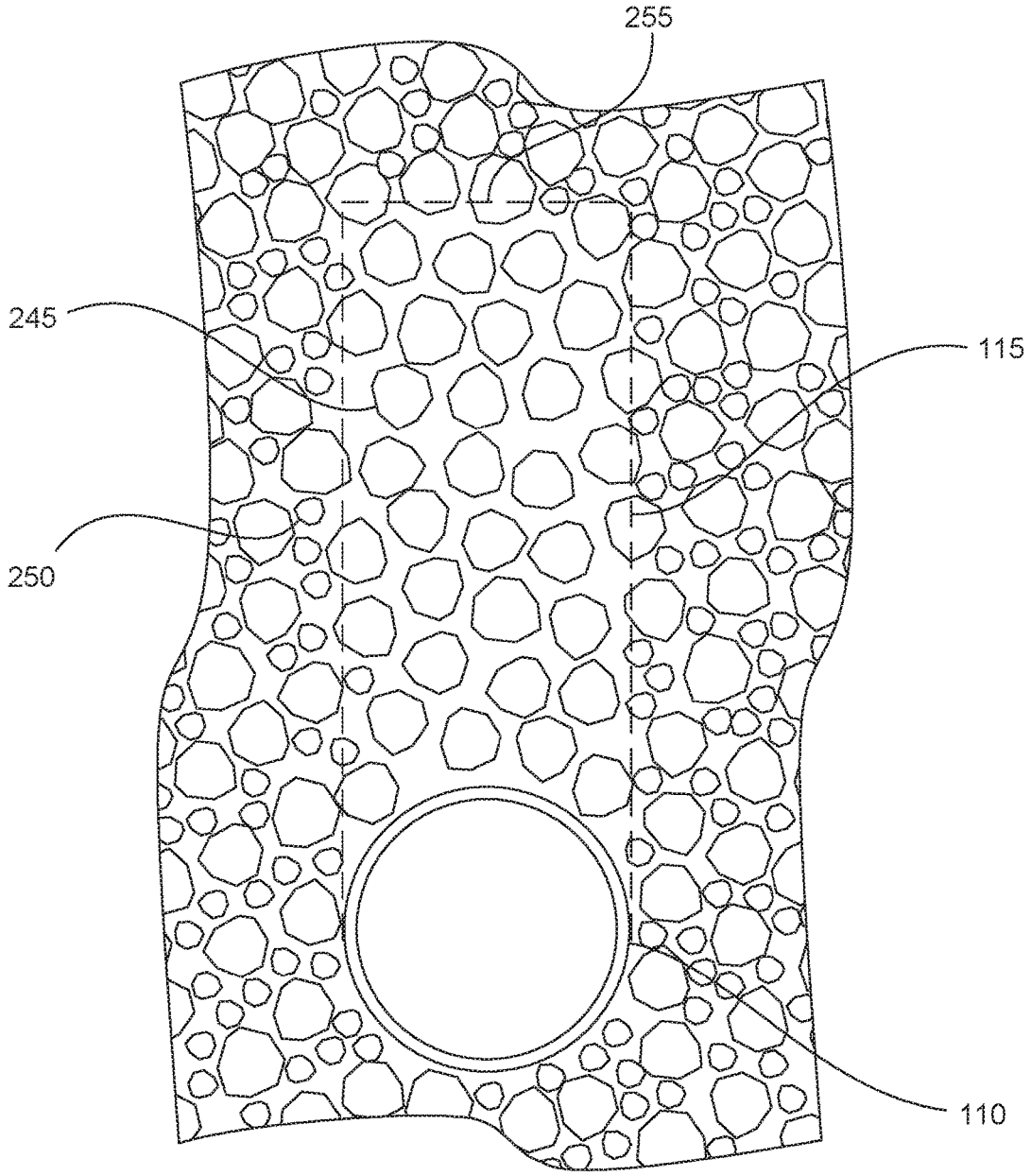
FIG. 2 is a close-up cross-section illustration of a pipe and an arching control volume in accordance with an embodiment of the present technology.

Regardless of the size and design of the impoundment, the present technology can be used to reduce stress on the pipes buried in the body of crushed hydrocarbonaceous material. FIG. 2 shows a close-up view of a single pipe 110 and an arching control volume 115 designated by the area inside the dashed line. The area outside the dashed line is designated as the support portion of the body of crushed hydrocarbonaceous material. The arching control volume contains crushed hydrocarbonaceous material having a higher void fraction than the material in the support portion. In this particular case, the material inside the arching control volume has a monomodal size distribution. As shown in the figure, the material is made up of larger particles 245 that are roughly uniform in size. In practice, the size of the particles can vary within a size distribution. A monomodal size distribution is a distribution with a single mode, or in other words, a single most common size of the particles. Most of the particles have sizes near this mode. In contrast, the figure shows that the support portion has a bimodal size distribution, made up of larger particles and smaller particles 250 mixed together. The bimodal size distribution has two local modes, one large and one small. The smaller particles tend to fill spaces between the larger particles that would otherwise be void spaces in a monomodal distribution. Thus, the overall void fraction of the support portion is lower than the void fraction of the arching control volume.

Although monomodal and bimodal size distributions are used in the example shown in FIG. 2, the other size distributions can also be used. For example, the arching control volume and the support portion can both have multimodal size distributions and the support portion can have more modes in its size distribution than the arching control volume. The arching control volume can have a bimodal size distribution while the support portion has a trimodal size distribution, and so on. In another example, the arching control volume can have a monomodal size distribution while the support portion has a trimodal or higher multimodal size distribution. By increasing the number of particle sizes from monomodal to bimodal or trimodal, the void fraction can in some cases be reduced from 50% to about 20%. Other factors besides size distribution can also be used to affect the void space of the arching control volume and the support portion. For example, the particles in the support portion can be shaped to pack more tightly while the particles in the arching control can be shaped to pack more loosely. Alternatively, the particles in the support portion can be compacted while the particles in the arching control volume are not compacted.

In some embodiments, the arching control volume can have a void fraction from about 30% to about 50%. The support portion can have a void fraction from about 20% to about 40%. In some cases, the void fraction of the arching control volume can be from about 5% to about 30% greater than the void fraction of the support portion.

The arching control volume 240 extends upward from the pipe 110 to a vertical control distance 255. The vertical control distance can be selected based on the desired reduction in stress on the pipe and the ability of the arching control volume and support portion to reduce the stress. In some cases, the vertical control distance can be at or above the plane of equal settlement. In such cases, the particles above the plane of equal settlement behave as if the entire body of crushed hydrocarbonaceous material has a homogeneous degree of subsidence, as if there is no pipe or arching control volume below. In other cases, the vertical control distance can be below the plane of equal settlement. In other cases, the vertical control distance can extend vertically to a top edge of the body crushed hydrocarbonaceous material.

Figure 3:
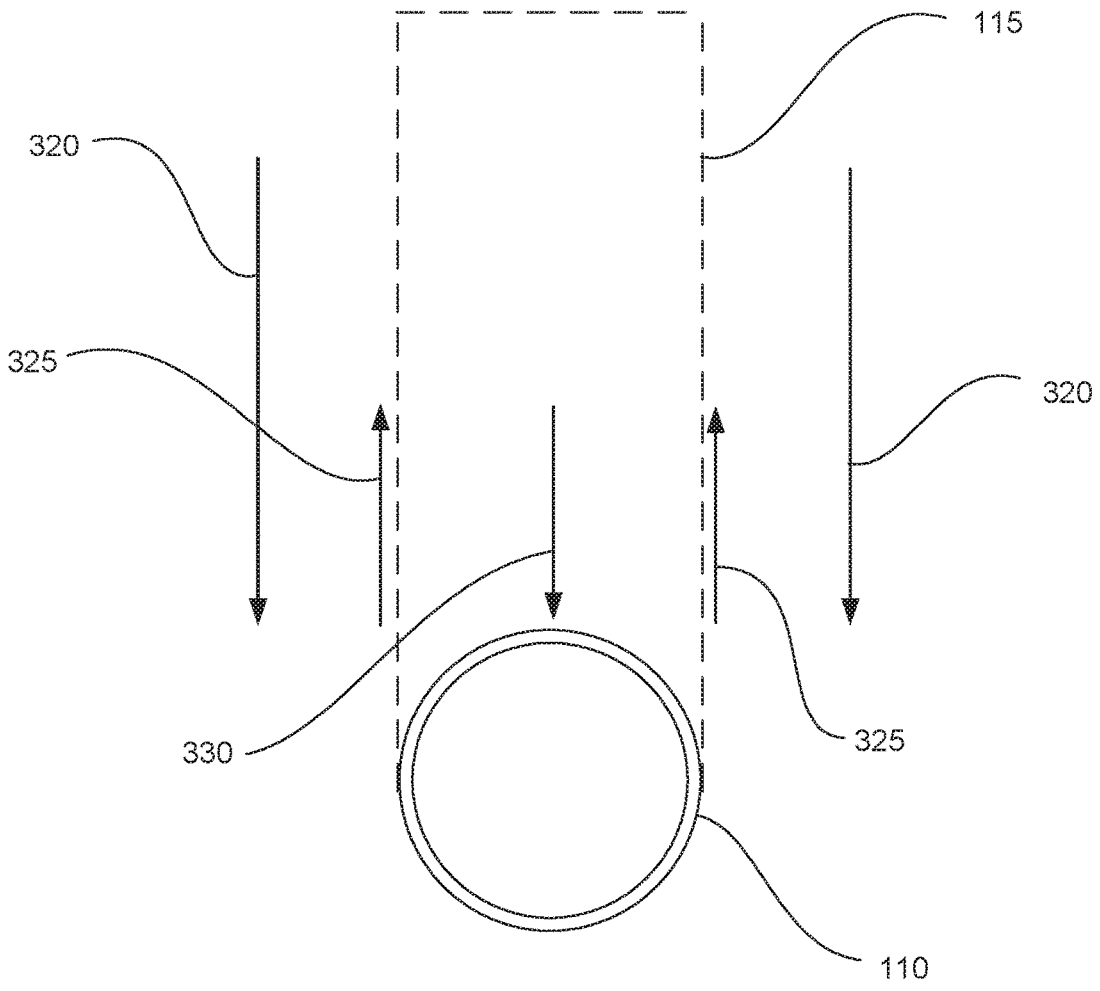
FIG. 3 is a schematic cross-section illustration of a pipe and an arching control volume in accordance with an embodiment of the present technology.

FIG. 3 shows a schematic view of the arching control volume 115 with arrows representing forces in various locations of the body of crushed hydrocarbonaceous material. The individual particles of hydrocarbonaceous material are omitted for clarity. The longest arrows 320 in the support portion represent the weight of the hydrocarbonaceous material in the support portion pushing down on the material below. The upward-pointing arrows 325 at the edges of the arching control volume represent an upward force that is exerted, through friction, by the support portion on the arching control volume. This force results from the fact that the support portion subsides less than the arching control volume. Therefore, the particles in the support portion are able to support a portion of the weight of the particles in the arching control volume. The arrow 330 pointing downward at the pipe 110 represents the resulting force pushing down on the pipe. This force is reduced by the upward force exerted by the support portion on the arching control volume.

In some cases, subsidence of the hydrocarbonaceous materials during hydrocarbon production can result in an overall decrease in the downward force on the pipe. However, the system can also be designed so that the force remains the same or increases somewhat during hydrocarbon production. Several factors can affect the force on the pipe. The difference in degree of subsidence between the arching control volume and the support portion is a major influence on the force. The larger the difference, the more the force on the pipe will be reduced. Therefore, in one embodiment, the difference in degree of subsidence can be maximized to minimize the force on the pipe. This can be accomplished by maximizing a difference in void fraction between the arching control volume and the support portion, for example. However, using a higher void fraction in the arching control volume involves a trade-off in that the higher void fraction material contains less hydrocarbonaceous material and therefore less hydrocarbon product can be extracted. Additionally, reducing the void fraction of the support portion below a certain value, such as 15-20%, can adversely affect production of hydrocarbons from the system because hot gases are not able to circulate through the body of hydrocarbonaceous material to heat the material. Although specific conditions can be tailored, the difference in void volume between the arching control volume and the support portion can range from 3% to 40%, and most often 5% to 25%. These ranges can also be adjusted depending on other contributing factors to subsidence.

For example, the degree of subsidence can also be affected by hydrocarbon content of the hydrocarbonaceous material. Therefore, the arching control volume can be made up of high hydrocarbon content material while the support portion is made up of lower hydrocarbon content material. In systems for extracting hydrocarbons from oil shale, the oil shale in the arching control volume can have a higher kerogen content than the oil shale in the support portion. However, using low hydrocarbon content material in the support portion can lower the overall productivity of the system compared to a system in which all the hydrocarbonaceous material has a high hydrocarbon content. Only as a general guideline and not to be considered limiting, a difference in hydrocarbon content between the arching control volume and the support volume can range from 5% to 60%, and in some cases 5% to 40%.

The force on the pipe can also be affected by the size of the arching control volume, i.e., the vertical control distance to which the arching control volume extends. The larger the vertical control distance, at least up to the plane of equal settlement, the more the force on the pipe will be reduced. In some embodiments, the vertical control distance can be from about 2 to about 6 times the diameter of the pipe, where the vertical control distance is measured from the top of the pipe. In further embodiments, the vertical control distance can be from about 4 to about 6 times the diameter of the pipe, from about 5 to about 6 times the diameter of the pipe, or greater than 6 times the diameter of the pipe. In yet other embodiments, the vertical control distance can be selected so that a cross section of the arching control volume has an area from about 2 to about 6 times an area of a cross section of the pipe when the cross sections are taken perpendicular to a longitudinal axis of the pipe. In alternative embodiments, the arching control volume can have a cross section that is from about 3 to about 8 times the area of the pipe cross section, from about 5 to about 8 times the area of the pipe cross section, or greater than 8 times the area of the pipe cross section. Increasing the vertical control distance further after passing the plane of equal settlement may not have a further effect on the force. Additionally, if the arching control volume has a higher void fraction that the support portions, then increasing the vertical control distance can reduce the overall hydrocarbon content in the system. This can lower productivity. Thus, there can be a trade-off between reducing the force on the pipe and productivity of the system.

Figure 4:
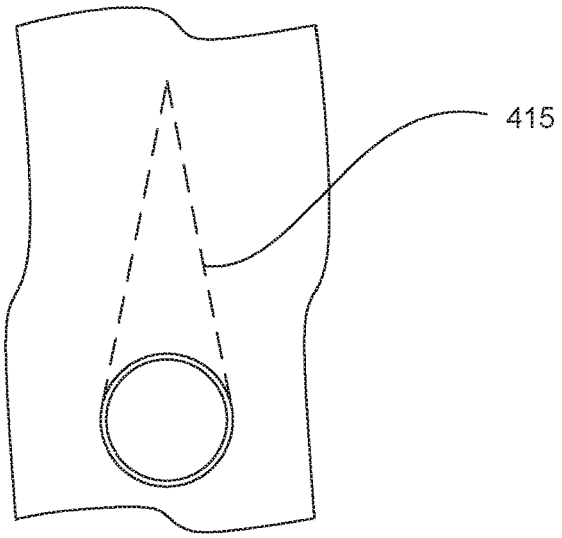
FIG. 4 is a schematic cross-section illustration of a pipe and an arching control volume in accordance with an embodiment of the present technology.
Figure 5:
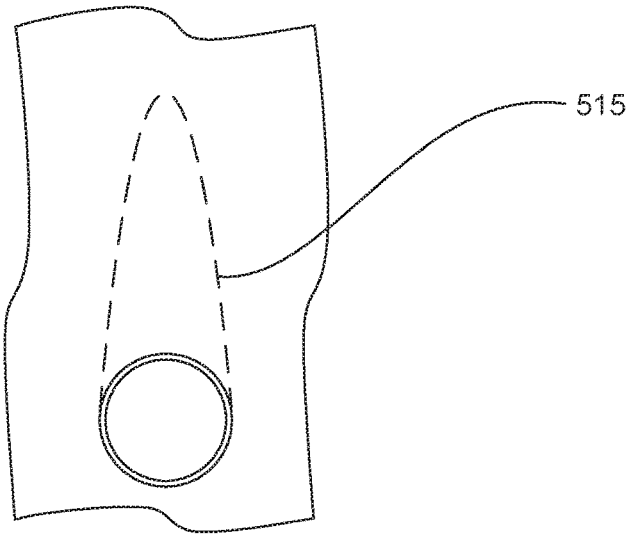
FIG. 5 is a schematic cross-section illustration of a pipe and an arching control volume in accordance with an embodiment of the present technology.

The arching control volume shown in FIGS. 2 and 3 is shaped as a column with straight sides and the same width as the pipe. This is only one example of an arching control volume. In other embodiments, the arching control volume can be designed to have a different shape. FIGS. 4 and 5 show a triangular arching control volume 415 and an arch-shaped arching control volume 515, respectively. It should be noted that the actual shape of an arching control volume may not be as well-defined as shown in the figures since crushed hydrocarbonaceous material naturally includes a variety of sizes and shapes of particles that can be difficult to place precisely. Although the figures show a dashed line with a sharp transition from the low void fraction support portion to the high void fraction arching control volume, in practice the transition may be less clear. Particles from the support portion and the arching control volume can intersperse with each other, making a more gradual transition from low void fraction to high void fraction. However, even if the transition is not precise, the volume defined as the arching control volume can have an overall higher void fraction than the support portion.

Regardless, appropriate shapes, sizes, void fractions, hydrocarbon contents, and other properties of the arching control volume and the support portion can be selected to achieve a desired reduction in force on the pipes. The amount of force that will be experienced by the pipes during subsidence can be predicted through theoretical calculations or by experimental data. Although several theories exist for calculating pressures caused by soil arching effects, these theories can often give differing results. Also, these theories have been developed for use in the context of soil arching, and may not be entirely applicable to hydrocarbon extraction systems. Theories developed for soil arching problems do not account for the greater degree of subsidence experienced by hydrocarbonaceous materials from which hydrocarbons are extracted. Thus, in some cases a more accurate prediction of pressures on the pipes in a hydrocarbon extraction system can be determined experimentally by those skilled in the art based on the guidelines presented herein. Any of the factors mentioned above can affect the amount of force on the pipes. Additionally, different hydrocarbonaceous material feedstocks can have different properties. For example, different hydrocarbonaceous materials can have different amounts of internal friction and cohesion between particles. Generally, higher friction between particles results in greater arching effects. Therefore, experimental data can be collected for a particular feedstock to help predict forces on the pipes.

The present technology can be used to reduce forces on pipes buried in a subsiding body of hydrocarbonaceous material. Reducing the forces on the pipes can reduce the likelihood of pipe breakage. This can allow for the use of inexpensive pipes with thinner walls. The resulting cost savings can be substantial when constructing an impoundment with many pipes or an array of multiple impoundments. This advantage can be balanced with reductions in hydrocarbon production that can result from changing the void fraction or hydrocarbon content of the material in the arching control volume and support portion, as explained above. In some cases, the system can be designed so that the total downward force on the pipes is reduced as the hydrocarbonaceous materials subside. In other cases, the above factors can be balanced so that the force on the pipes stays roughly the same during subsidence. In still further cases, the force on the pipe can increase somewhat as the hydrocarbonaceous materials subside. However, in any of the above cases, the force on the pipes during subsidence can be reduced compared to the force that would have been exerted on the pipes if no arching control volume had been used.

The present technology is applicable to any size of pipes. In the systems described herein, the pipes can often have a diameter from about 1 ft. to about 5 ft. In more specific embodiments, the pipes can have a diameter from about 2 ft. to about 4 ft., or about 3 ft. The pipes can also have a wall thickness of from about ⅛ inch to about 1 inch. Pipes can be buried in the body of crushed hydrocarbonaceous material, and spaced apart by from about 5 ft. to about 30 ft. In more specific embodiments, the pipes can be spaced apart by from about 10 ft. to about 20 ft.

Materials for the pipes can vary. In some examples, the pipes can be clay pipes, refractory cement pipes, refractory ECC pipes, poured in place pipes, cast iron pipes, carbon steel pipes, stainless steel pipes, corrugated steel pipes, polymer pipes, or other types of pipe. Because the force on the pipes due to subsidence of the hydrocarbonaceous materials is reduced by the arching control volume, the pipes can be made from comparatively weaker materials without risking breakage of the pipes.

Because the body of hydrocarbonaceous material can subside by a large amount, it can be useful to configure the pipes so that the pipes can move with the subsiding hydrocarbonaceous material. Therefore, in some embodiments the pipes can include features that allow the pipes to move with the subsiding material. In one example, the pipes can include flexible pipe segments. In one embodiment, the flexible segments can be flexible corrugated pipe. In another embodiment, the pipes can be entirely made from flexible corrugated pipe. In another example, the pipes can include a pipe manifold that is able to collapse vertically as the hydrocarbonaceous material subsides.

Figure 6:
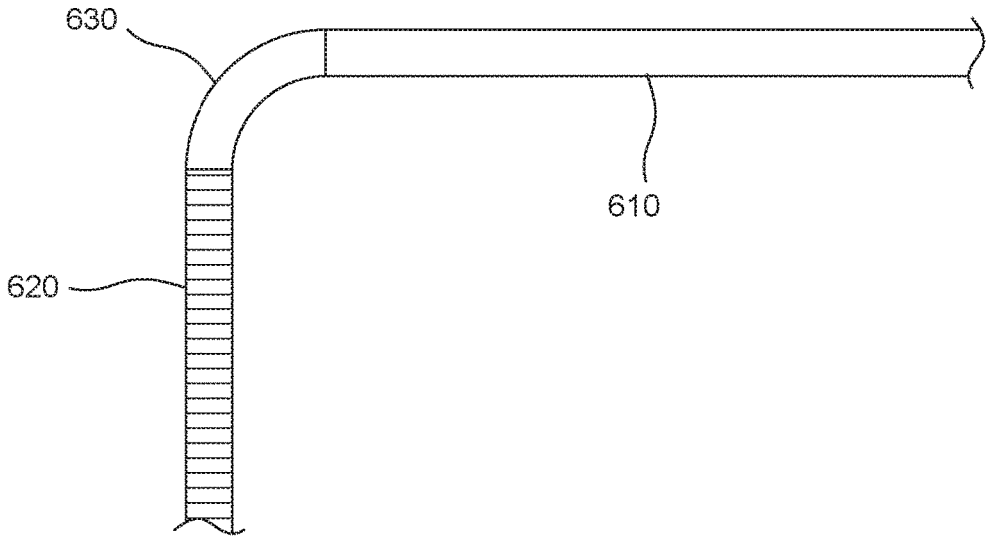
FIG. 6 is a side view illustration of a lateral conduit and compactible vertical riser in accordance with an embodiment of the present technology.
Figure 7:
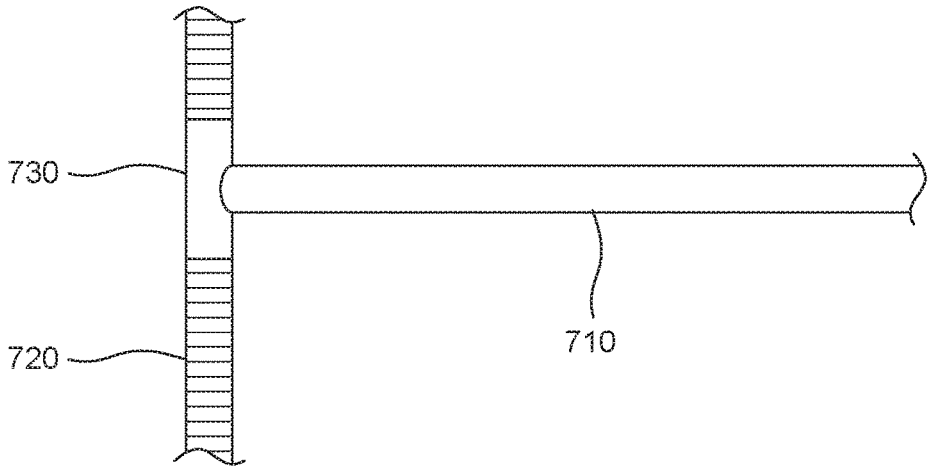
FIG. 7 is a side view illustration of a lateral conduit and compactible vertical riser in accordance with an embodiment of the present technology.
Figure 8:
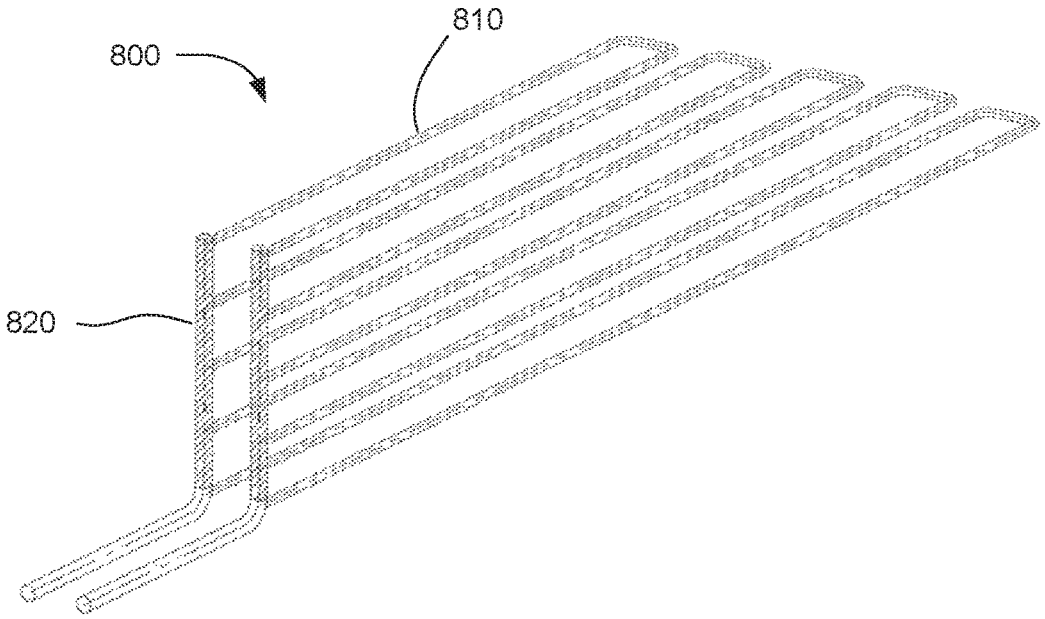
FIG. 8 is a perspective view of a pipe system in accordance with an embodiment of the present technology.
Figure 9:
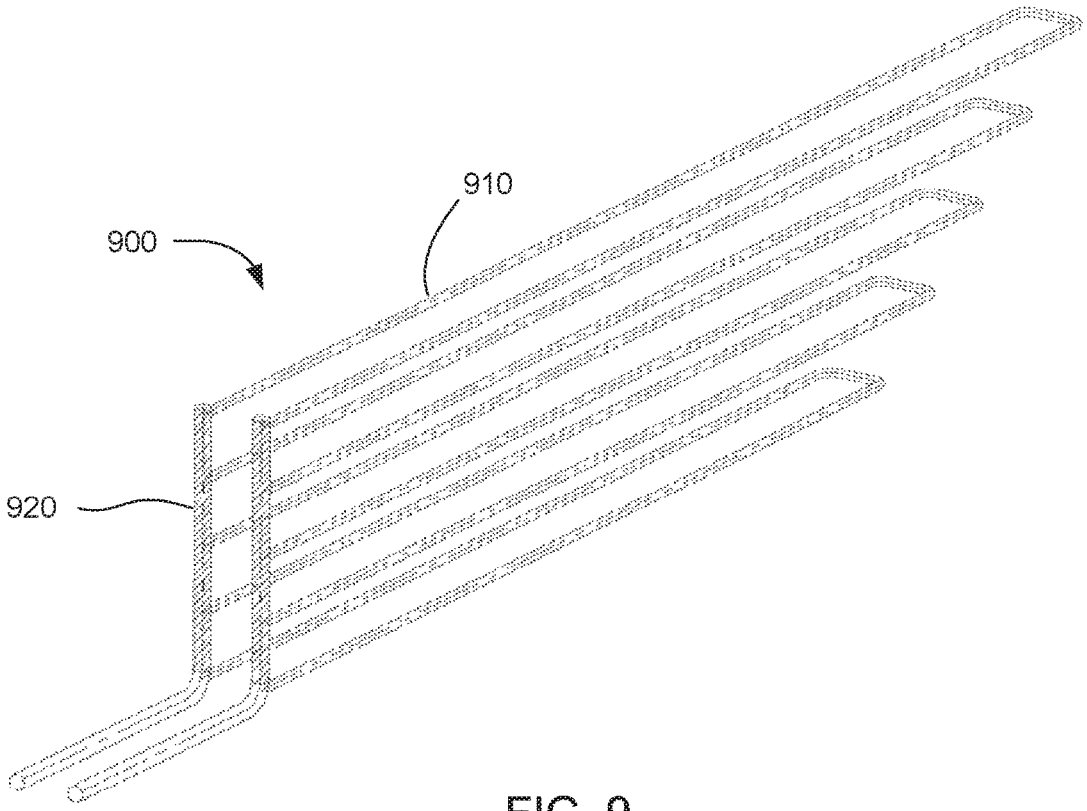
FIG. 9 is a perspective view of a pipe system in accordance with an embodiment of the present technology.
Figure 10:
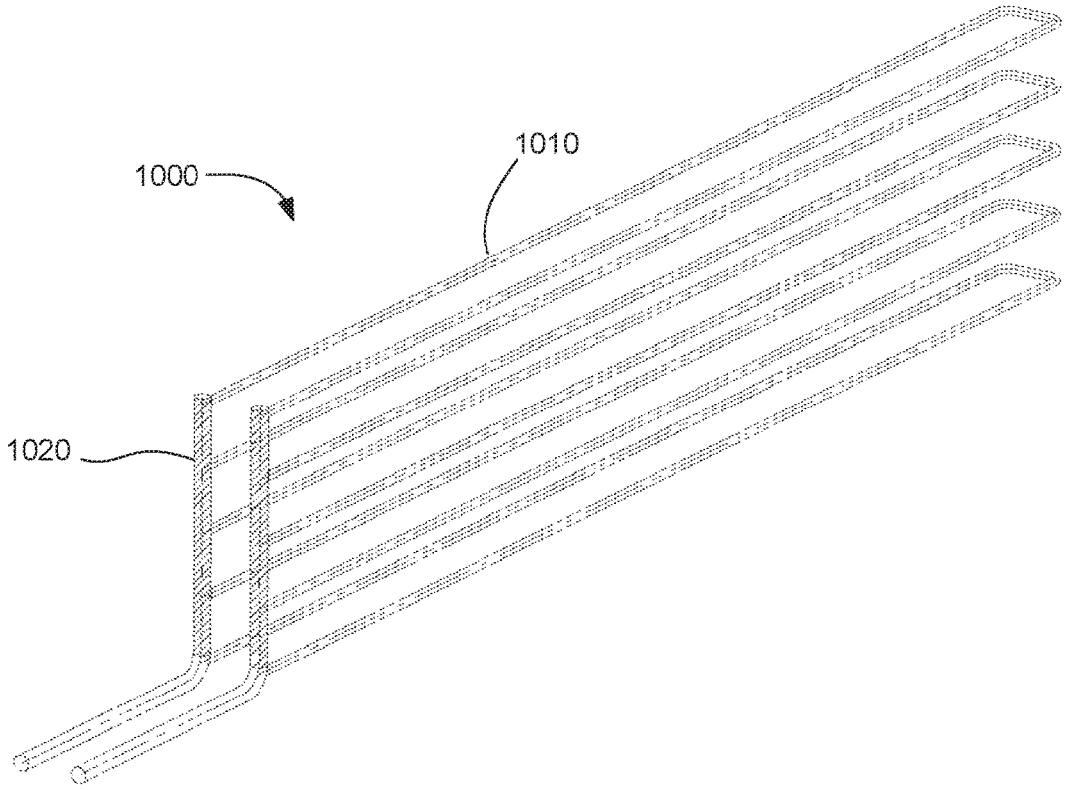
FIG. 10 is a perspective view of a pipe system in accordance with an embodiment of the present technology.
Figure 11:
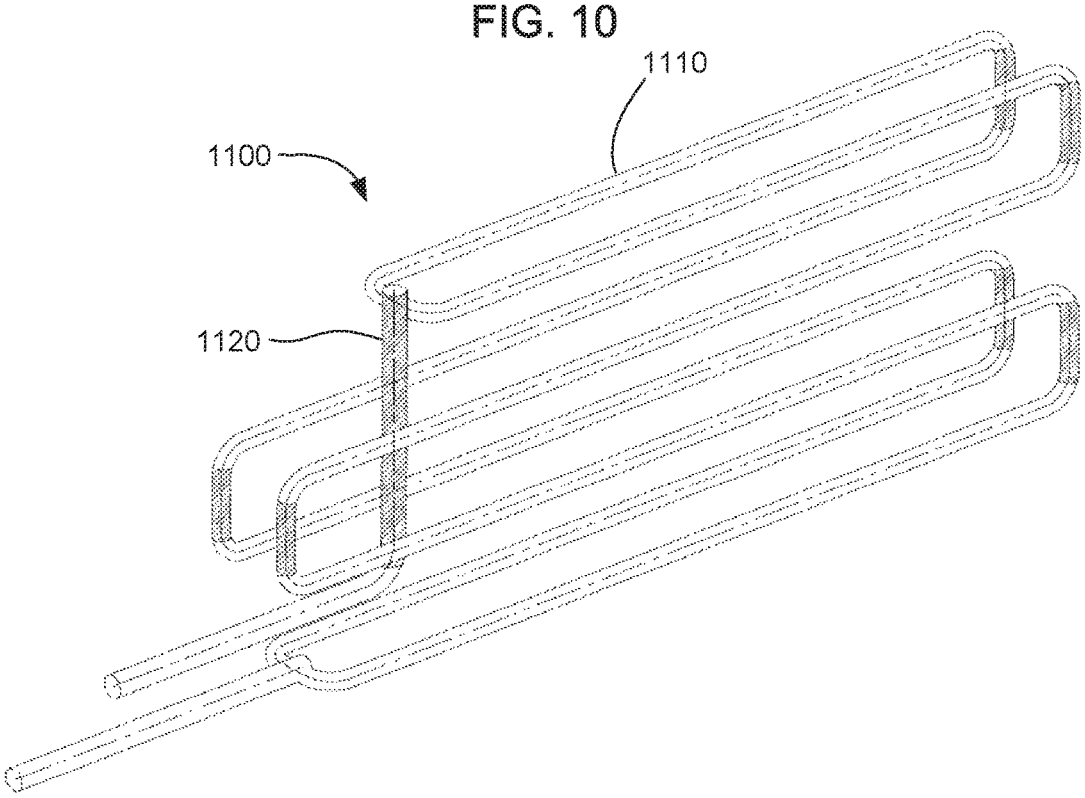
FIG. 11 is a perspective view of a pipe system in accordance with an embodiment of the present technology.

In some embodiments, the pipes can include lateral heat transfer conduits connected to compactible risers. FIGS. 6 and 7 show examples of coupling configurations for a lateral heat transfer conduit and a riser. As shown in FIG. 6, a lateral heat transfer conduit 610 can be coupled to an end of a riser 620. For example, the lateral heat transfer conduit and/or the riser can include a transition portion 630 that transitions between a lateral orientation of the lateral heat transfer conduit and a vertical orientation of the riser. In one aspect, the transition portion can comprise an "elbow" having a 90 degree angle. The transition portion allows heat transfer fluid to flow between the lateral heat transfer conduit and the riser while having sufficient strength to maintain structural integrity of the coupling between the lateral heat transfer conduit and the riser when the lateral heat transfer conduit lowers. As shown in FIG. 7, a lateral heat transfer conduit 710 can be coupled to a mid portion of a riser 720. In one aspect, the transition portion 730 can form at least a part of a "T" connection providing a 90 degree angle between the lateral heat transfer conduit and the riser. As illustrated in FIG. 7, the transition portion is devoid of corrugations, which can be beneficial for structural integrity of the coupling between the lateral heat transfer conduit and the riser. The transition portions can thus provide for a structurally sound transition from the lateral heat transfer conduit to the vertically collapsible features of the riser. It should be noted, however, that the lateral heat transfer conduit can also couple directly to the vertically collapsible features of the riser without a transition portion.

FIGS. 8-11 show piping systems 800, 900, 1000, and 1100 which include lateral pipes 810, 910, 1010, and 1110 connected to vertical risers 820, 920, 1020, and 1120. In these embodiments, the entire vertical risers are corrugated and the lateral risers connect directly to the corrugated risers. The risers can act as manifolds with multiple lateral pipes branching from the manifolds. A variety of other configurations of pipes can also be used in the systems according to the present technology.

In some embodiments, the system for extracting hydrocarbons from crushed hydrocarbonaceous material can include a pipe with an arching control volume extending upward from the pipe. The system can also include a second pipe with a second arching control volume extending upward. The second pipe can be positioned directly above the first pipe, and the two pipes can be separated by a distance that is greater than the vertical control distance. Both pipes can be surrounded on top, bottom, and sides by crushed hydrocarbonaceous material. As shown in the figures, the system can include a plurality of pipes arrange in vertical columns and/or horizontal rows within the impoundment. The arching control volumes can all have identical vertical control distances, or the vertical control distances can differ. In one embodiment, the vertical control distances can increase with increasing height in the impoundment. In another embodiment, the vertical control distances can decrease with increasing height in the impoundment.

The present technology also extends to methods for constructing a system for extracting hydrocarbons from crushed hydrocarbonaceous material. An exemplary method can include depositing a layer of crushed hydrocarbonaceous material in an enclosure, orienting a pipe on the layer of crushed hydrocarbonaceous material, and then depositing additional crushed hydrocarbonaceous material within the enclosure. This can form a structured body of crushed hydrocarbonaceous material including an arching control volume that extends above the pipe. Support portions can include the hydrocarbonaceous material immediately adjacent the sides of the arching control volume. The hydrocarbonaceous material in the arching control volume can have a higher void fraction that the hydrocarbonaceous material in the support portion.

Figure 12:
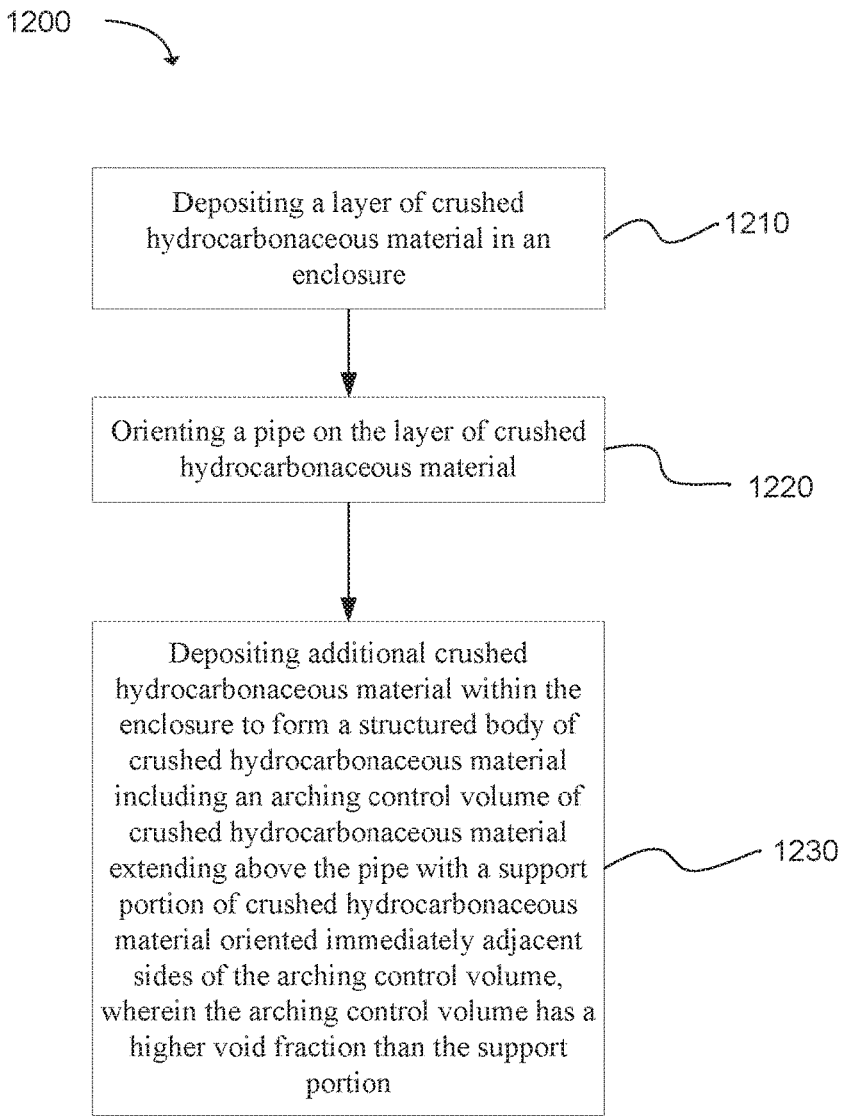
FIG. 12 is a flow chart of a method of constructing a system for extracting hydrocarbons from a crushed hydrocarbonaceous material in accordance with an embodiment of the present technology.

FIG. 12 is a flow chart of a method 1200 of constructing a system for extracting hydrocarbons from a crushed hydrocarbonaceous material in accordance with an embodiment of the present technology. The method comprises: depositing a layer of crushed hydrocarbonaceous material in an enclosure 1210; orienting a pipe on the layer of crushed hydrocarbonaceous material 1220; and depositing additional crushed hydrocarbonaceous material within the enclosure to form a structured body of crushed hydrocarbonaceous material including an arching control volume of crushed hydrocarbonaceous material extending above the pipe with a support portion of crushed hydrocarbonaceous material oriented immediately adjacent sides of the arching control volume, wherein the arching control volume has a higher void fraction than the support portion 1230.

The body of crushed hydrocarbonaceous material can be formed inside an impoundment as described above. The body of crushed hydrocarbonaceous material, insulating layer, barrier layer, and outer wall supports can be formed with any of the compositions and dimensions as discussed above. The impoundment can be formed using any suitable approach. However, in one aspect, the impoundment is formed from the floor up. The formation of the wall or walls and filling of the enclosure with crushed hydrocarbonaceous material can be accomplished simultaneously in a vertical deposition process where materials are deposited in a predetermined pattern. For example, multiple chutes or other particulate delivery mechanisms can be oriented along corresponding locations above the deposited material. By selectively controlling the volume of particulate delivered and the location along the aerial view of the system where each respective particulate material is delivered, the layers and structure can be formed simultaneously from the floor to the ceiling. The sidewall portions of the impoundment can be formed as a continuous upward extension at the outer perimeter of the floor and each layer present, including the body of crushed hydrocarbonaceous material, the insulating layer, the impermeable layer, and optionally outer walls formed of compacted earthen material, are constructed as a continuous extension of the floor counterparts. During the building up of the sidewalls, the body of crushed hydrocarbonaceous material can be simultaneously placed on the floor and within the sidewall perimeter such that, what will become the enclosed space, is being filled simultaneously with the rising of the constructed sidewall. In this manner, internal retaining walls or other lateral restraining considerations can be avoided. This approach can also be monitored during vertical build-up in order to verify that intermixing at interfaces of layers is within acceptable predetermined tolerances (e.g. maintain functionality of the respective layer). For example, excessive intermingling of the barrier layer materials with the insulating material in the insulating layer may compromise the sealing function of the barrier layer. This can be avoided by careful deposition of each adjacent layer as it is built up and/or by increasing deposited layer thickness. Hydrated materials in the barrier layer can be deposited dry and then hydrated after the impoundment is complete. Alternately, a first horizontal layer of dry material can be deposited, followed by hydrating the layer, and then another layer of dry material can be deposited on top of the first layer, and then hydrated, and so on.

The pipes can be placed in the body of crushed hydrocarbonaceous material as the body is formed by deposition in layers from the bottom up. After laying a pipe, additional crushed hydrocarbonaceous material can be deposited up to the level of the top of the pipe. Then, additional layers of crushed hydrocarbonaceous material can be added while forming an arching control volume of high void fraction hydrocarbonaceous material directly over the pipe. In each layer, an amount of high void fraction material can be deposited at the location of the arching control volume while lower void fraction material is deposited throughout the rest of the layer. In this way, the arching control volume is built up layer by layer from high void fraction material. Once the vertical control distance is reached, uniform layers of lower void fraction material can be deposited. This process can be repeated with additional pipes and additional arching control volumes until the entire impoundment is formed.

In one embodiment, the crushed hydrocarbonaceous material can be deposited without any packing or compacting. Both the high void fraction and low void fraction material can be allowed to fall into place naturally, and the void fraction can be controlled by particle size distribution in the materials. In an alternative embodiment, the low void fraction material can be compacted as the layers are deposited.

In a specific embodiment, the arching control volume and supporting portion can be formed by depositing hydrocarbonaceous material having a monomodal size distribution in the arching control volume, and depositing hydrocarbonaceous material having a multimodal size distribution in the support portion.

The present technology also extends to methods of reducing stress on a buried pipe during extraction of hydrocarbons from a crushed hydrocarbonaceous material. One exemplary method can include heating a body of crushed hydrocarbonaceous material. The body of crushed hydrocarbonaceous material can surround a pipe and comprise an arching control volume of crushed hydrocarbonaceous material extending upward from the pipe to a vertical control distance. The body of crushed hydrocarbonaceous material can further include a support portion of crushed hydrocarbonaceous material which is oriented immediately adjacent sides of the arching control volume. The arching control volume can have a higher void fraction than the support portion. The method can further include producing hydrocarbon products from the crushed hydrocarbonaceous material such that the crushed hydrocarbonaceous material decreases in volume causing subsidence of the crushed hydrocarbonaceous material. When this subsidence occurs, frictional forces between the arching control volume and the support portion can mitigate stress on the pipe due to subsidence. The hydrocarbon products produced from the body of crushed hydrocarbonaceous material can be extracted.

Figure 13:
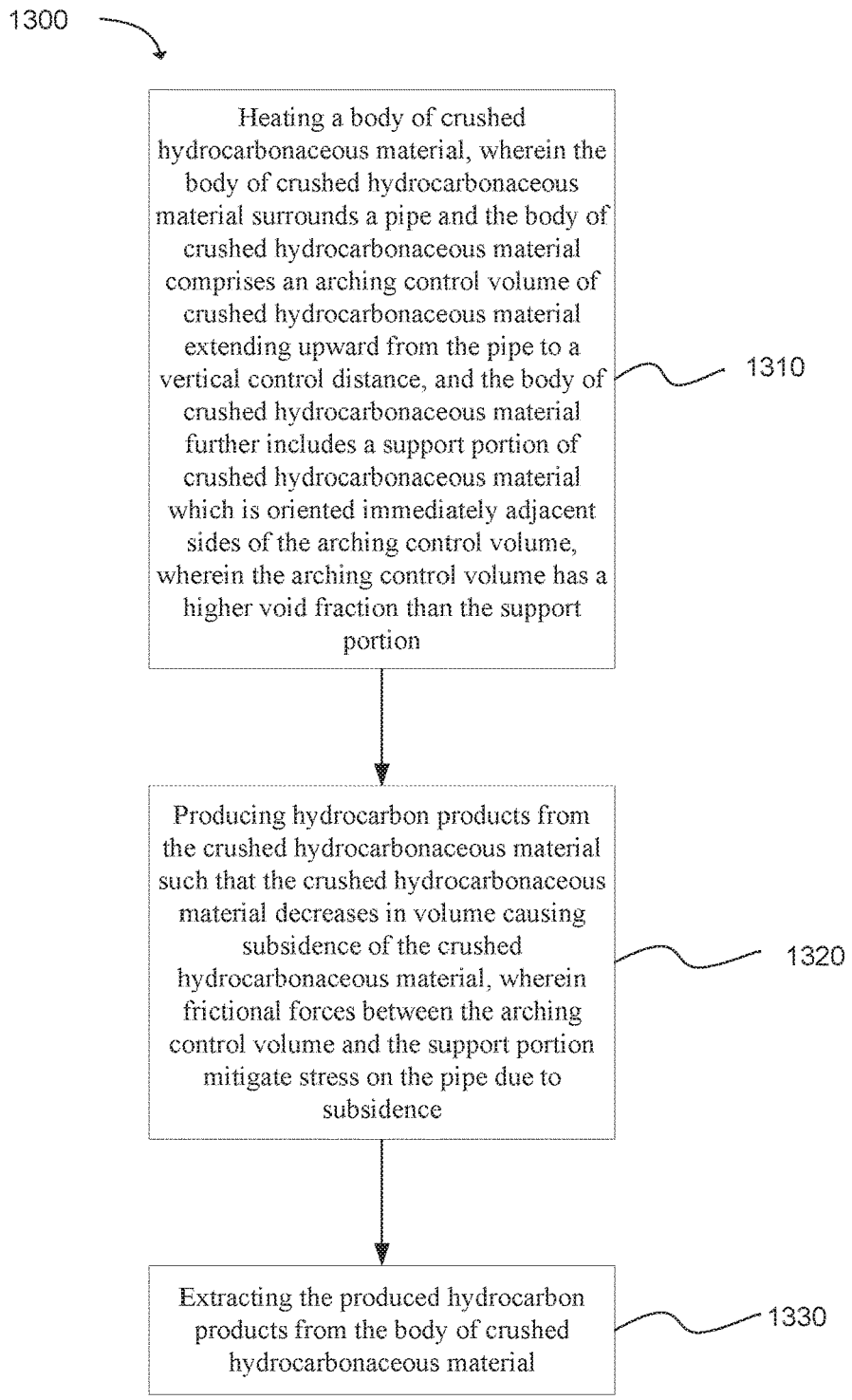
FIG. 13 is a flow chart of a method of reducing stress on a buried pipe during extraction of hydrocarbons from a crushed hydrocarbonaceous material in accordance with an embodiment of the present technology.

FIG. 13 is a flow chart of a method 1300 of reducing stress on a buried pipe during extraction of hydrocarbons from a crushed hydrocarbonaceous material in accordance with an embodiment of the present technology. The method includes: heating a body of crushed hydrocarbonaceous material, wherein the body of crushed hydrocarbonaceous material surrounds a pipe and the body of crushed hydrocarbonaceous material comprises an arching control volume of crushed hydrocarbonaceous material extending upward from the pipe to a vertical control distance, and the body of crushed hydrocarbonaceous material further includes a support portion of crushed hydrocarbonaceous material which is oriented immediately adjacent sides of the arching control volume, wherein the arching control volume has a higher void fraction than the support portion 1310; producing hydrocarbon products from the crushed hydrocarbonaceous material such that the crushed hydrocarbonaceous material decreases in volume causing subsidence of the crushed hydrocarbonaceous material, wherein frictional forces between the arching control volume and the support portion mitigate stress on the pipe due to subsidence 1320; and extracting the produced hydrocarbon products from the body of crushed hydrocarbonaceous material 1330.

In one embodiment, the production of hydrocarbon products can continue until the total subsidence of the crushed hydrocarbonaceous material is from about 10% to about 40%. In another embodiment, the production can continue until the upper surface of the body of crushed hydrocarbonaceous material subsides by from about 1 m to about 15 m. The production can also continue until the pipe drops by from about 1 m to about 15 m due to the subsidence. The production of hydrocarbons can continue for a time from about 2 days to about 2 years, or for any of the time periods described above.

In some cases, the top-down stress on the pipe after subsidence can be less than the top-down stress on the pipe before subsidence. However, in other cases, the top-down stress can stay roughly the same or can increase when the subsidence occurs.

Aspects of the present technology can also be applied to systems other than hydrocarbon removal. Any system involving pipes or other equipment oriented with a subsiding body of particulate material can potentially benefit from the use of arching control volumes as described herein. Arching control volumes can be especially useful in systems where a substance is extracted from the particulate material, causing the particulate material to subside significantly more than usual. In some examples, arching control volumes can be used in systems such as copper or gold heat bleaching systems.

The described features, structures, or characteristics may be combined in any suitable manner in one or more examples. In the preceding description numerous specific details were provided, such as examples of various configurations to provide a thorough understanding of examples of the described technology. One skilled in the relevant art will recognize, however, that the technology may be practiced without one or more of the specific details, or with other methods, components, devices, etc. In other instances, well-known structures or operations are not shown or described in detail to avoid obscuring aspects of the technology.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. A system for extracting hydrocarbons from a crushed hydrocarbonaceous material, comprising:

a body of crushed hydrocarbonaceous material; and a pipe oriented within the body of crushed hydrocarbonaceous material such that the pipe is surrounded on top, bottom, and sides of the pipe by the crushed hydrocarbonaceous material;

wherein the body of crushed hydrocarbonaceous material comprises an arching control volume of crushed hydrocarbonaceous material extending upward from the top of the pipe to a vertical control distance, and the body of crushed hydrocarbonaceous material further includes a support portion of crushed hydrocarbonaceous material which is oriented immediately adjacent sides of the arching control volume and in contact with the bottom of the pipe, wherein the arching control volume has a higher void fraction than the support portion.

2. The system of claim 1, wherein the arching control volume has a monomodal particle size distribution and the support portion has a multimodal particle size distribution.

3. The system of claim 1, wherein the arching control volume has a void fraction from about 30% to about 50% and the support portion has a void fraction from about 20% to about 40%.

4. The system of claim 1, wherein the void fraction of the arching control volume is from about 5% to about 30% greater than the void fraction of the support portion.

5. The system of claim 1, wherein the arching control volume has a higher kerogen content than the support portion.

6. The system of claim 1, wherein the vertical control distance is from about 2 to about 6 times a diameter of the pipe.

7. The system of claim 1, wherein a cross section of the arching control volume has an area from about 2 to about 6 times an area of a cross section of the pipe when the cross sections are taken perpendicular to a longitudinal axis of the pipe.

8. The system of claim 1, wherein the pipe comprises a flexible portion to allow the pipe to lower as crushed hydrocarbonaceous material under the pipe subsides.

9. The system of claim 1, further including a second pipe oriented directly above the first pipe and separated from the first pipe by a vertical distance that is greater than the vertical control distance, wherein the second pipe is surrounded on top, bottom, and sides by the crushed hydrocarbonaceous material and a second arching control volume extends upward to the vertical control distance from the second pipe.

10. The system of claim 1, further comprising a plurality of pipes connected to a pipe manifold, wherein each pipe is surrounded on top, bottom, and sides by the crushed hydrocarbonaceous material and a plurality of arching control volumes extend upward to the vertical control distance from each pipe.

11. The system of claim 1, further comprising a surface of undisturbed earth beneath the body of crushed hydrocarbonaceous material and the body of crushed hydrocarbonaceous material is one-half to ten acres in top plan surface area.

12. The system of claim 1, further comprising a layer of particulate material on top of the body of crushed hydrocarbonaceous material, wherein the particulate material is a different material from the crushed hydrocarbonaceous material.

13. A method of constructing a system for extracting hydrocarbons from a crushed hydrocarbonaceous material, comprising:

depositing a layer of crushed hydrocarbonaceous material in an enclosure;

orienting a pipe on the layer of crushed hydrocarbonaceous material; and depositing additional crushed hydrocarbonaceous material within the enclosure to form a structured body of crushed hydrocarbonaceous material including an arching control volume of crushed hydrocarbonaceous material extending from a top of the pipe and above the pipe with a support portion of crushed hydrocarbonaceous material oriented immediately adjacent sides of the arching control volume and in contact with a bottom of the pipe, wherein the arching control volume has a higher void fraction than the support portion.

14. The method of claim 13, wherein depositing additional crushed hydrocarbonaceous material comprises depositing crushed hydrocarbonaceous material having a higher void fraction in the arching control volume while depositing crushed hydrocarbonaceous material having a lower void fraction in the support portion, until a vertical control distance is reached; and then depositing an upper layer of crushed hydrocarbonaceous material having a lower void fraction over both the support portion and the arching control volume.

15. The method of claim 14, further comprising orienting a second pipe on the upper layer of crushed hydrocarbonaceous material, and then depositing additional crushed hydrocarbonaceous material over the second pipe to form a second structured body of crushed hydrocarbonaceous material including a second arching control volume extending above the second pipe.

16. The method of claim 13, wherein depositing crushed hydrocarbonaceous material is performed without compacting either the arching control volume or the support portion.

17. The method of claim 13, wherein the arching control volume has a monomodal particle size distribution and the support portion has a multimodal particle size distribution.

18. The method of claim 13, further comprising forming the enclosure from particulate materials.

19. The method of claim 18, wherein forming the enclosure comprises forming an insulating layer comprising particulate material surrounding the crushed hydrocarbonaceous material and pipe, the insulating layer having a smaller average particle size than the crushed hydrocarbonaceous material.

20. The method of claim 19, wherein forming the enclosure further comprises forming an impermeable layer comprising hydrated clay encapsulating the insulating layer.

21. A method of reducing stress on a buried pipe during extraction of hydrocarbons from a crushed hydrocarbonaceous material, comprising:

heating a body of crushed hydrocarbonaceous material, wherein the body of crushed hydrocarbonaceous material surrounds a pipe and the body of crushed hydrocarbonaceous material comprises an arching control volume of crushed hydrocarbonaceous material extending upward from a top of the pipe to a vertical control distance, and the body of crushed hydrocarbonaceous material further includes a support portion of crushed hydrocarbonaceous material which is oriented immediately adjacent sides of the arching control volume and in contact with a bottom of the pipe, wherein the arching control volume has a higher void fraction than the support portion;

producing hydrocarbon products from the crushed hydrocarbonaceous material such that the crushed hydrocarbonaceous material decreases in volume causing subsidence of the crushed hydrocarbonaceous material, wherein frictional forces between the arching control volume and the support portion mitigate stress on the pipe due to subsidence; and extracting the produced hydrocarbon products from the body of crushed hydrocarbonaceous material.

22. The method of claim 21, wherein the producing hydrocarbon products comprises producing hydrocarbon products until the total subsidence of the crushed hydrocarbonaceous material is from about 10% to about 40%.

23. The method of claim 21, wherein the subsidence causes the pipe to drop from about 1 m to about 15 m.

24. The method of claim 21, wherein top-down stress on pipe after subsidence is less than top-down stress on the pipe before subsidence.

25. The method of claim 21, wherein heating the body of crushed hydrocarbonaceous material and producing hydrocarbon products are performed for a time from about 1 week to about 2 years.

* * * * *